US006202631B1

(12) United States Patent
Yamamoto et al.

(10) Patent No.: US 6,202,631 B1
(45) Date of Patent: Mar. 20, 2001

(54) VENTILATING UNIT FOR CARBURETOR

(75) Inventors: Katsumi Yamamoto; Shosuke Suzuki, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/216,918

(22) Filed: Dec. 21, 1998

(30) Foreign Application Priority Data

Dec. 24, 1997 (JP) ..... 9-355420

(51) Int. Cl.[7] ..... F02M 37/04
(52) U.S. Cl. ..... 123/516; 123/517
(58) Field of Search ..... 123/517, 516, 123/520, 519, 518, 521

(56) References Cited

U.S. PATENT DOCUMENTS 2,965,086 * 12/1960 Gregory ..... 123/516
3,460,522 * 8/1969 Kittler ..... 123/516
4,577,607 * 3/1986 Nishio ..... 123/516
5,732,686 * 3/1998 Yokoyama ..... 123/520

FOREIGN PATENT DOCUMENTS

0041724 * 3/1977 (JP) ..... 123/517
6-185414 * 5/1994 (JP) ..... 123/516
7-166961 6/1995 (JP) .

* cited by examiner

*Primary Examiner*—Carl S. Miller
(74) *Attorney, Agent, or Firm*—Birch, Stewart, Kolasch & Birch, LLP

(57) ABSTRACT

To maintain a float chamber at atmospheric pressure by quickly discharging fuel from the float chamber even when a relatively large amount of fuel gushes into the float chamber. A float chamber is provided for containing a predetermined quantity of fuel. The float chamber includes an upper end and a bottom. Main air paths are provided that include lower ends and upper ends. The lower ends are in communication with a space disposed above a surface of the fuel in the float chamber of the carburetor. A plurality of branches include lower ends and upper ends. The lower ends of the branches are open to the atmosphere. At least one expansion chamber is provided that is in communication with the upper ends of the main air paths and the upper ends of the plurality of branches. The at least one expansion chamber is positioned above the float chamber and includes a larger cross-sectional area relative to a cross-sectional area of the main air paths and the branches. Therefore, neither of the branches are blocked by fuel, and attenuated fuel will be quickly discharged via the main air paths and one of the branches.

9 Claims, 7 Drawing Sheets

VENTILATING UNIT FOR CARBURETOR

BACKGROUND OF THE INVENTION

1. Field of the Invention

This invention relates to a ventilating unit for a carburetor attached to an internal combustion engine. More particularly, to main air paths having their lower ends open to a space above a surface of fuel in a float chamber of the carburetor. A plurality of branches communicate with upper ends of the main air paths via upper ends thereof and are open to the atmosphere via lower ends thereof.

2. Description of Background Art

Japanese Patent Laid-Open No. Hei 7-166961 exemplifies a ventilating unit for a carburetor which includes two branches.

FIG. 6 shows an example of existing ventilating units for a carburetor. In FIG. 6, a carburetor body 1 includes a float chamber 3 provided under the carburetor body 1. A space 3*a* positioned above a surface of fuel in the float chamber 3 opens to the atmosphere via a pair of ventilating units. Each ventilating unit includes a passage 30 in the shape of letter T. In the passage 30, a portion $\mathbf{30}_1$ serves as a main air path 12, and extends from an end on the ceiling to a merging point 30*a*. A portion $\mathbf{30}_2$ extends laterally from the merging point 30*a* and then vertically downwardly to the carburetor body, and is coupled to a first ventilating tube 16, thereby forming a first branch 13. A portion $\mathbf{30}_3$ extends upwardly from the merging point 30*a* and connects to a second ventilating tube 18 in the shape of an inverted letter U, thereby forming a second branch 14.

Even if a motorcycle including the foregoing ventilating system runs on a rough road, extensive rippling occurs on the surface of the fuel f in the float chamber 3 and fuel f partially intrudes into the main air paths 12 and the first branches 13 and the second branches 14 allow atmospheric pressure to act on the main air paths 12 and the first branches 13. In such a case, the fuel intruding into the main air paths 12 and the first branches 13 is separated, so that a part thereof is returned to the float chamber 3 via the main air paths 12 while the remaining fuel will be quickly dispersed into the atmosphere via the first branches 13. Therefore, it is possible to minimize a period during which fuel stays in the ventilating unit 10 and to maintain the float chamber 3 at atmospheric pressure.

In the related art, each merging point 30*a* where the main air path 12 and the first and second branches 13 and 14 communicate with one another has a cross-sectional area that is substantially equal to those of the passage 12 and the branches 13 and 14. If a relatively large amount of fuel f gushes into the main air paths 12 from the float chamber 3, it also enters into the first and second branches 13 and 14 at the same time, as shown in FIG. 7. In such a case, it is difficult for atmospheric pressure to act on the merging point 30*a*, which delays the flow of fuel f to the float chamber 3 and the atmosphere. In this state, the float chamber 3 is isolated from the atmosphere. As a result, a fuel nozzle communicating with the float chamber 3 under the upper surface of fuel f may infect fuel with reduced efficiency, which may adversely affect ease of riding.

SUMMARY AND OBJECTS OF THE INVENTION

This invention is aimed at overcoming the foregoing problems of the related art, and provides a ventilating unit for a carburetor in order to prevent fuel from intruding into all of the branches even when a relatively large amount of fuel gushes into main air paths from a float chamber, enabling such intruding fuel to flow down to the float chamber and to be dispersed into the atmosphere, and stabilizing fuel injection by a fuel nozzle.

In order to accomplish the object, a first feature of the invention is to provide a ventilating system for a carburetor, in which main air paths have lower ends opening to a space above a surface of the fuel in a float chamber of the carburetor, upper ends communicating with upper ends of a plurality of branches, and the branches open to the atmosphere via lower ends. The upper ends of the main air paths and the upper ends of the branches communicate with one another via the expansion chambers that are positioned above the float chamber and have larger cross-sectional areas than cross-sectional areas of the main air paths of the branches.

According to the first feature, even when a relatively large amount of fuel gushes into the main air paths, it is attenuated in the expansion chambers having large cross-sectional areas. There is sufficient room around fuel in the expansion chambers, so that all of such fuel does not simultaneously enter into the branches.

Therefore, since the expansion chambers are continuously supplied with atmospheric pressure via a part of the branch which is free from the intruding fuel, the fuel attenuated by the expansion chamber flows down via the main air paths to return to the float chamber.

In a second feature, the branches open on the bottom and ceiling of the expansion chambers, in addition to the first feature.

It is possible to maximize distances between the upper ends of a plurality of branches according to the second feature, and to reliably prevent fuel from simultaneously entering into the branches from the expansion chambers.

According to a third feature, the upper ends opening on the bottom of the expansion chambers and the upper ends opening on the ceiling of the expansion chambers are arranged with extension axes thereof mutually displaced in addition to the first or second features.

In accordance with the third feature, fuel that gushes into the main air paths toward the ceiling of the expansion chambers can be effectively prevented from entering into the branches because of the displaced extension axes of the main air paths and branches. Therefore, the expansion chambers can be reliably maintained at atmospheric pressure by the branches.

According to a fourth feature, the upper ends of the main air paths and the upper end of at least one of the branches open on the bottom of the expansion chambers, and the upper ends of the main air paths are positioned above the upper ends of the branches, in addition to the first, second or third features.

In the fourth feature, fuel gushing into the expansion chambers can quickly flow down separately via the main air paths and the branches. When the top surface of fuel in the expansion chambers is at a lever lower than the upper ends of the main air paths, fuel is no longer returned to the main air paths. This is effective in reducing a time period during which fuel stays in the main air paths. Therefore, fuel remaining in the expansion chambers flows downwardly only through the branches, and will be discharged outwardly therefrom.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
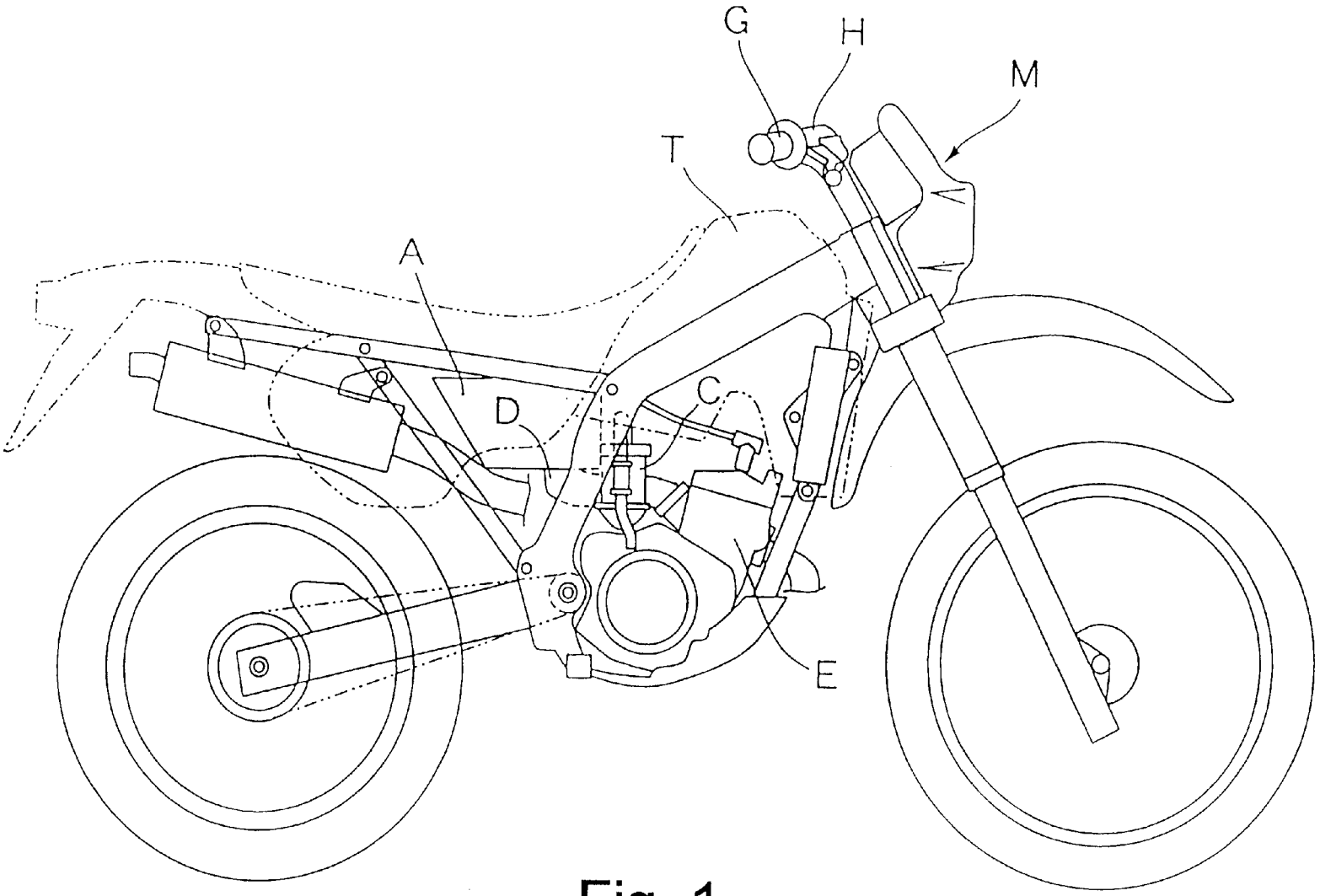
FIG. 1 is a side view of a motorcycle which includes an internal combustion engine provided with a carburetor having a ventilating system.

The invention will be described with reference to an embodiment shown in the drawings.

Referring to FIG. 1, a carburetor C is attached to an inlet port of an internal combustion engine E of an off-road type motorcycle. An air cleaner A is coupled to the inlet port via an inlet duct D.

Figure 2:
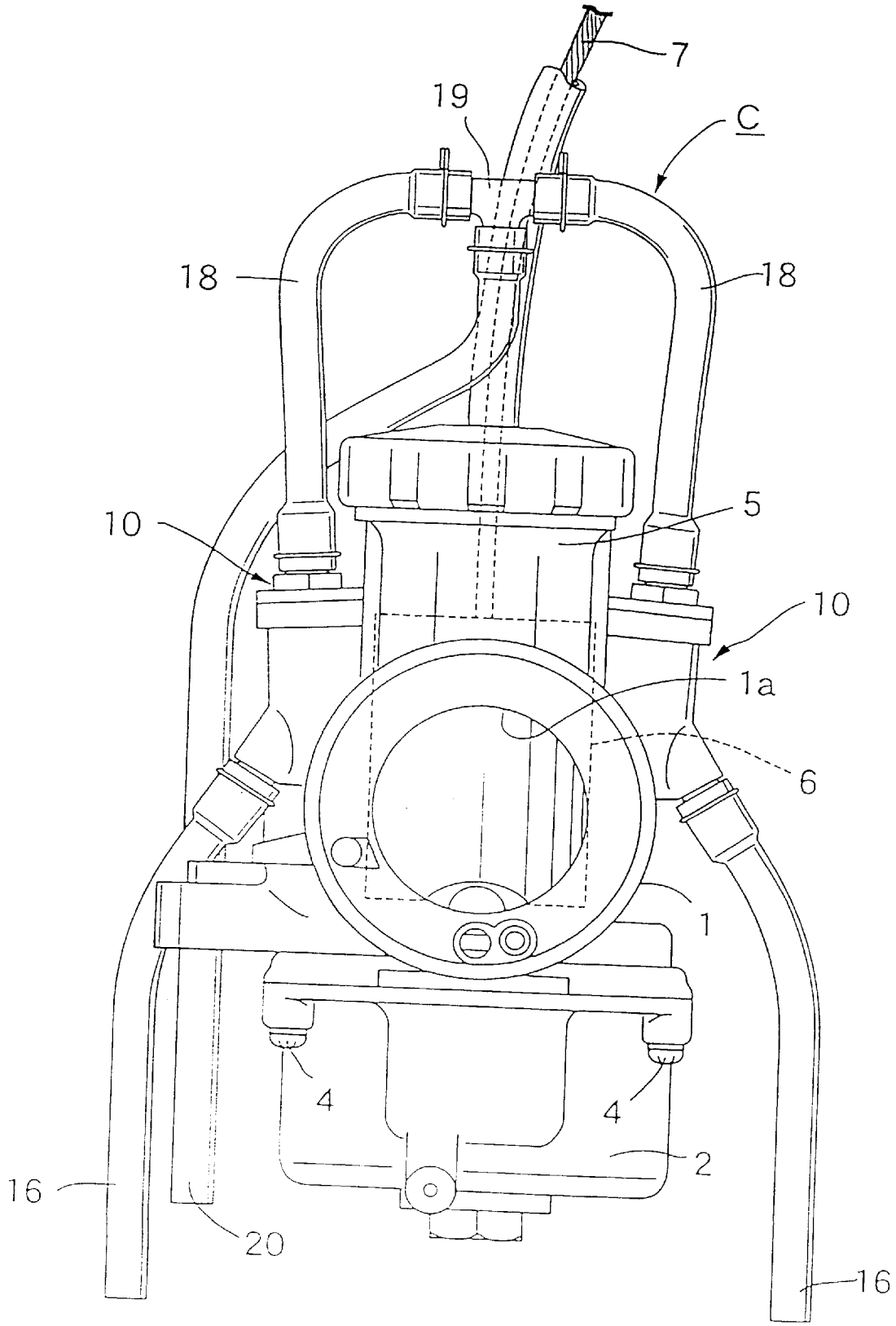
FIG. 2 is a rear elevation of the carburetor having the ventilating system.
Figure 3:
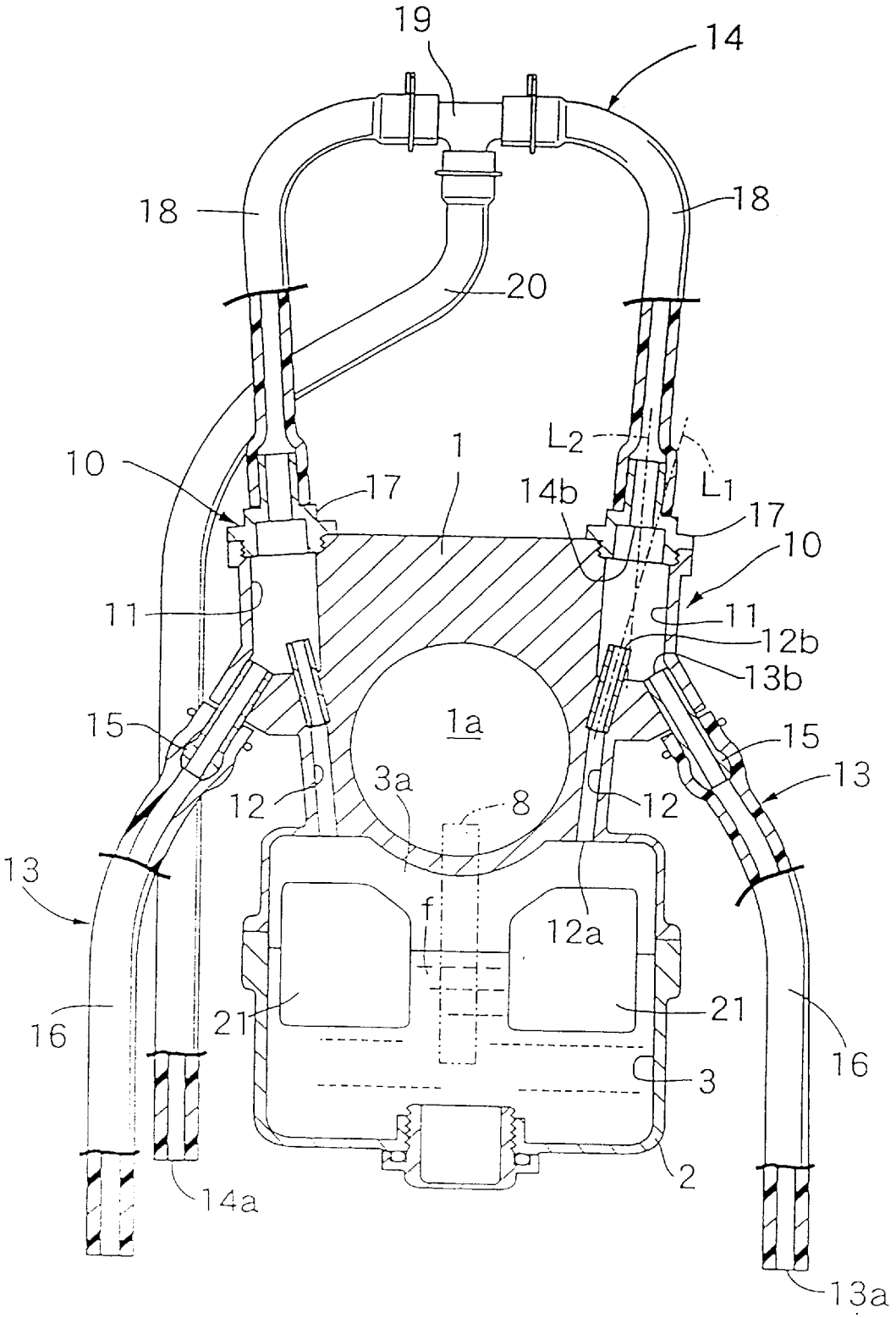
FIG. 3 is a cross section of the carburetor having the ventilating system.
Figure 4:
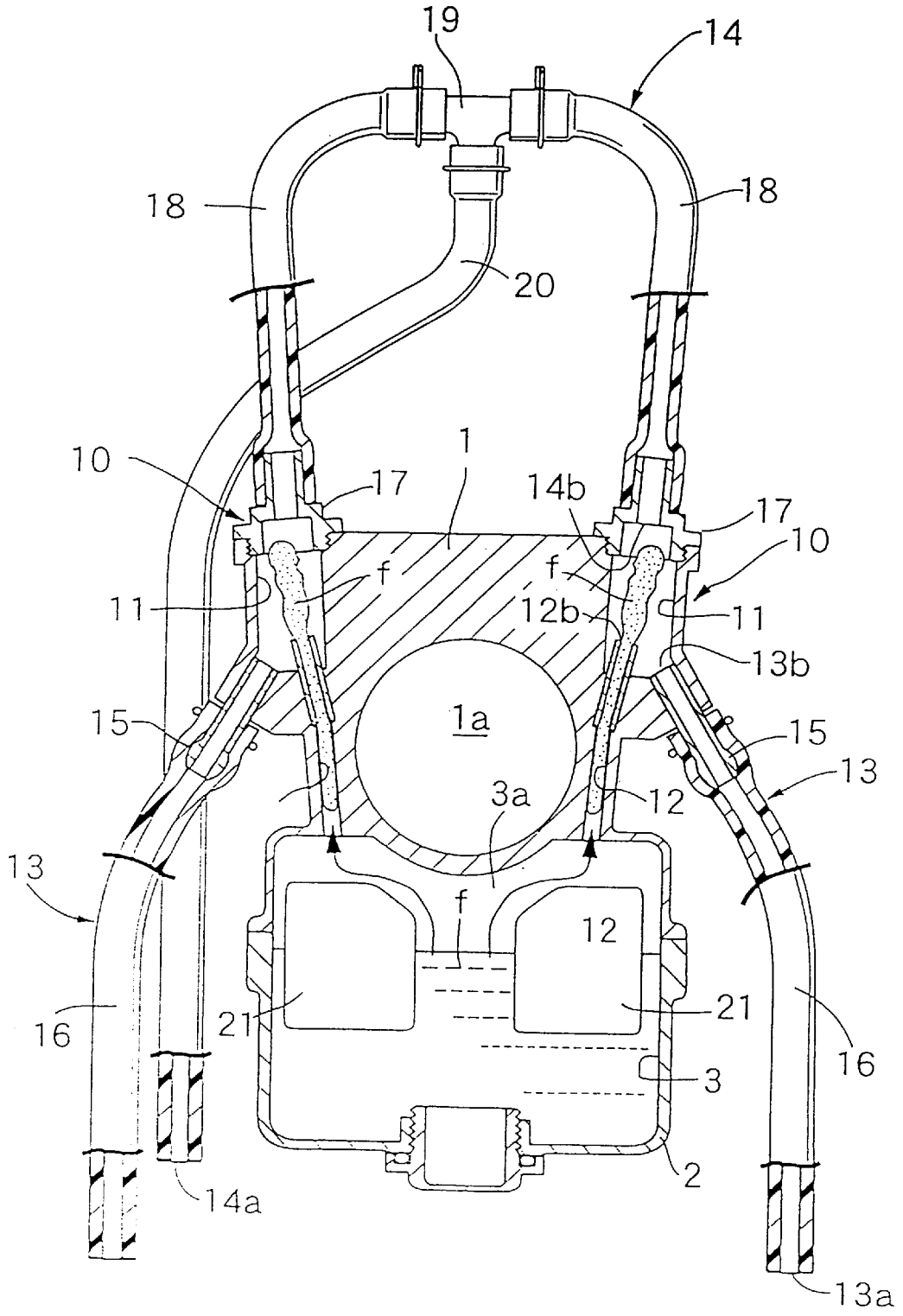
FIG. 4 shows the operation of the ventilating system.
Figure 5:
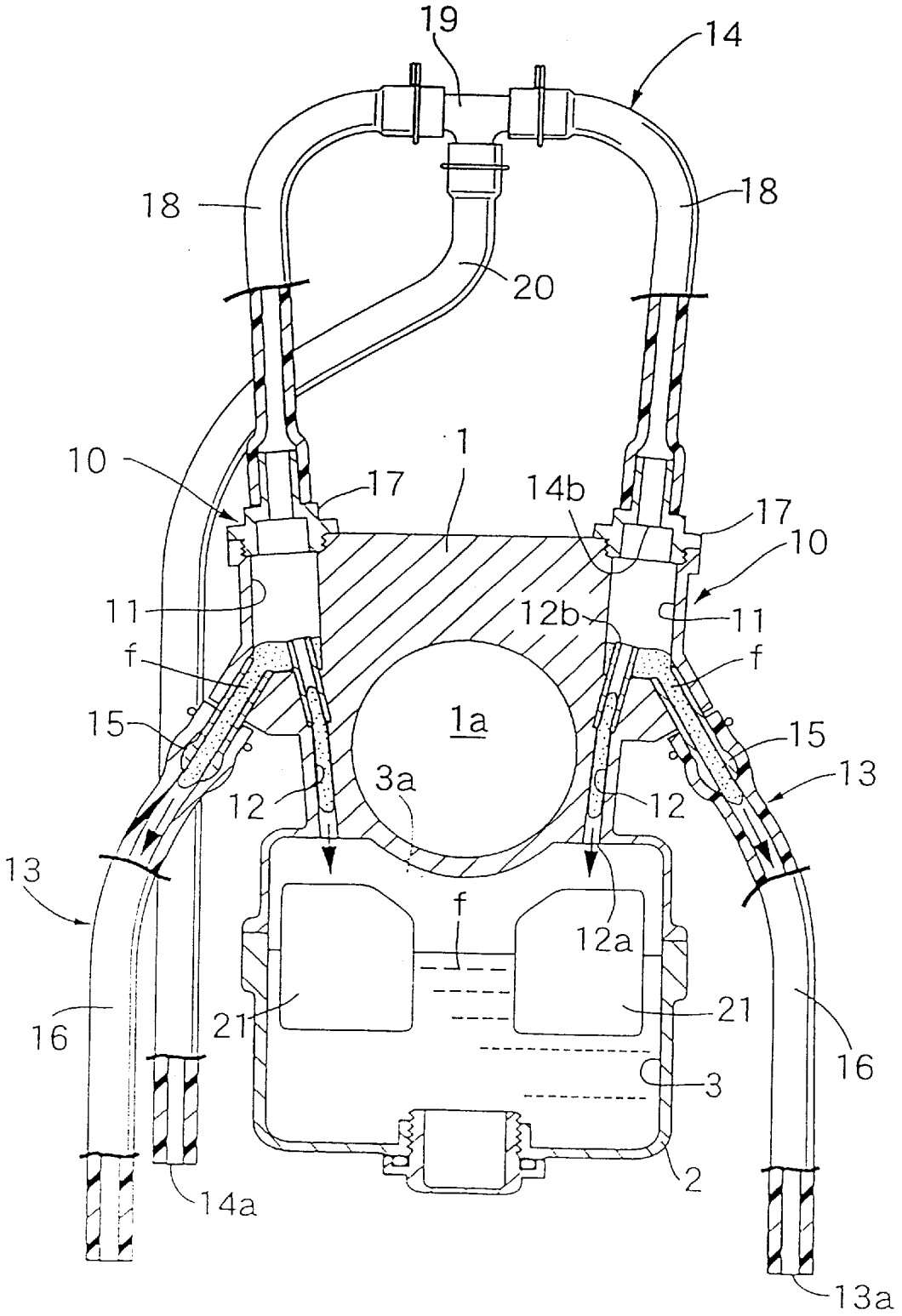
FIG. 5 shows another operation of the ventilating system.
Figure 6:
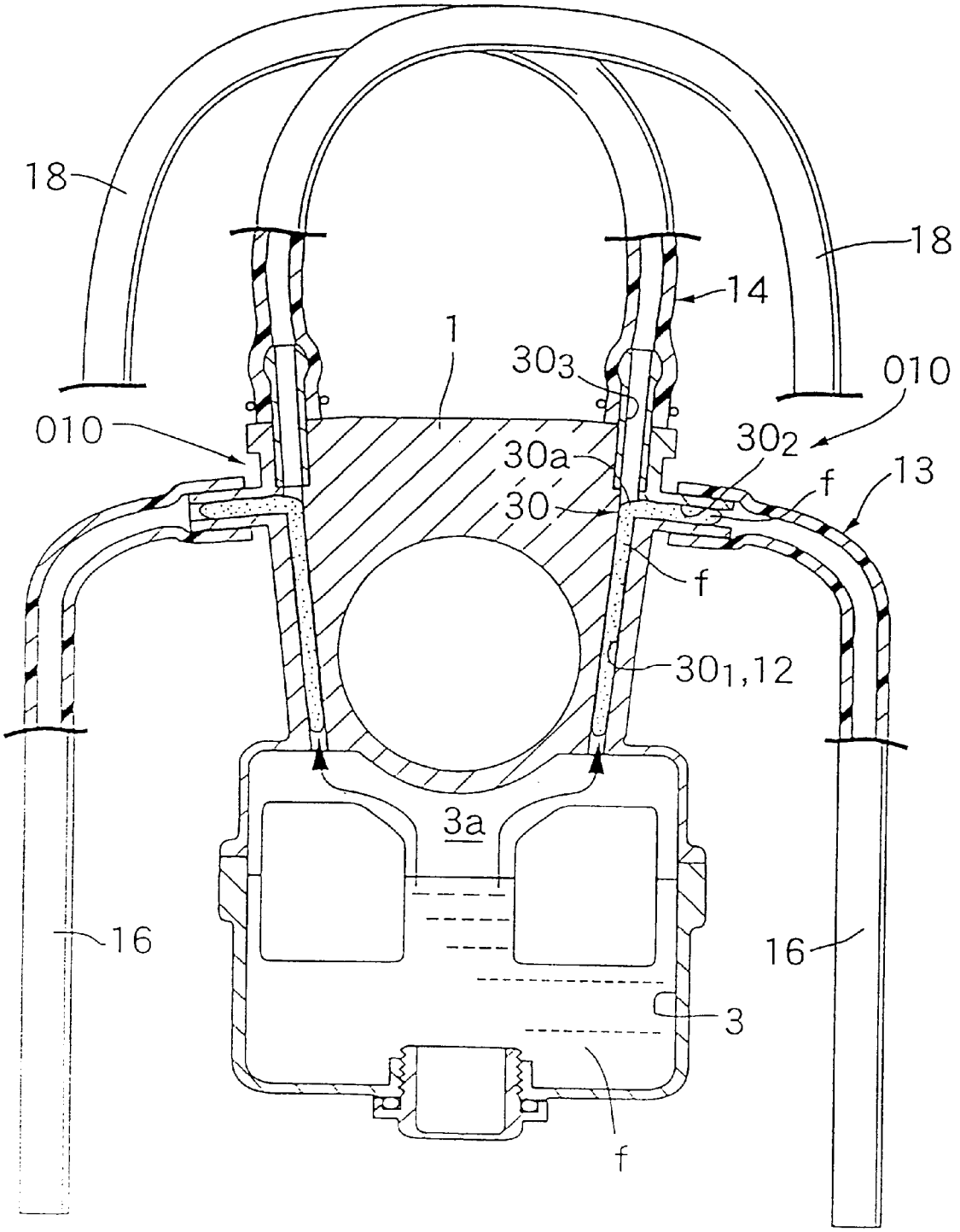
FIG. 6 is a cross section of a ventilating system for a carburetor in the related art.
Figure 7:
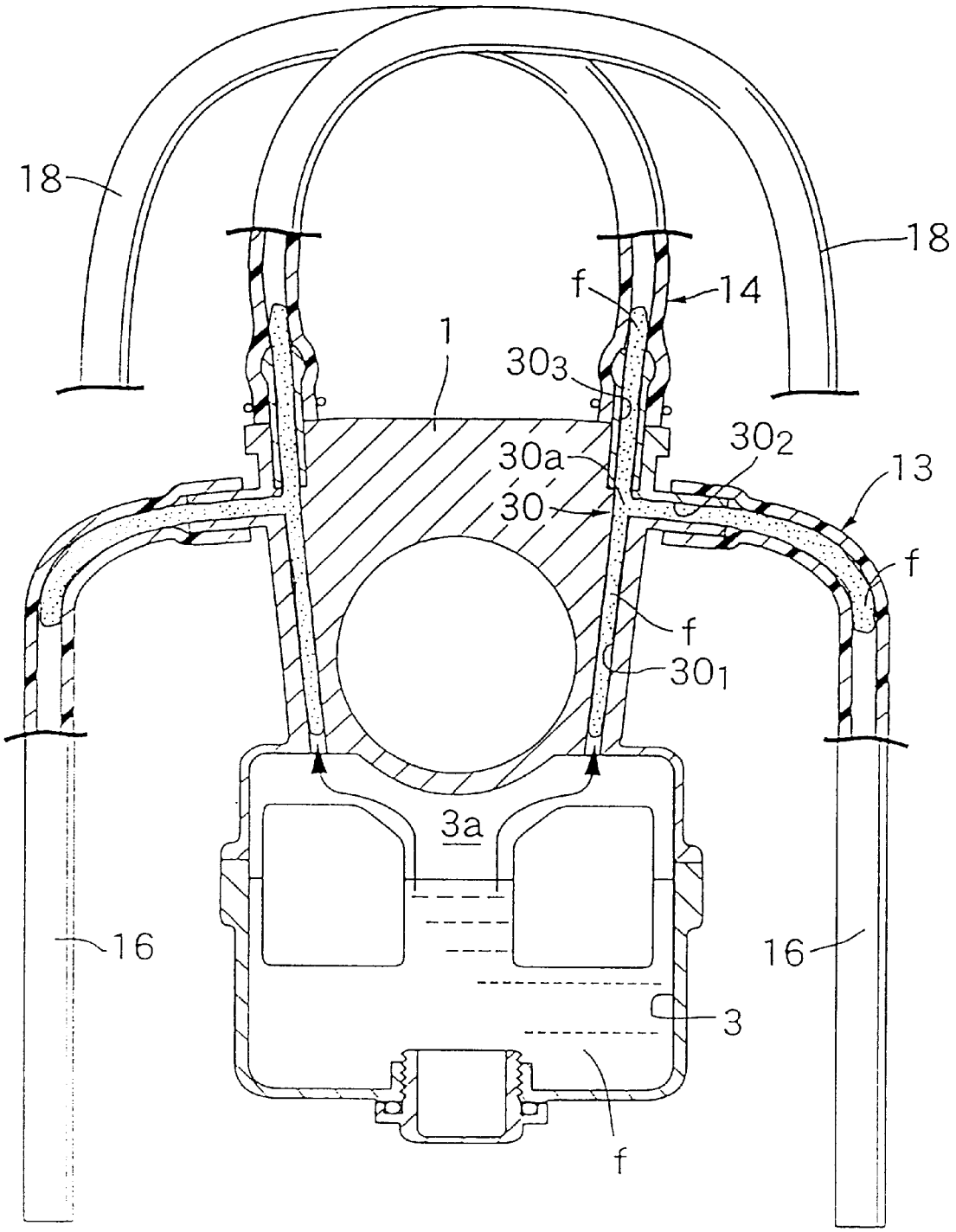
FIG. 7 shows the operation of the ventilating system in the related art.

As shown in FIGS. 2 and 3, the carburetor C includes a carburetor body 1 having a horizontal inlet path 1*a*, and a float chamber body 2 attached to the bottom of the carburetor body 1 using small screws 4 in order to define a float chamber 3 under the carburetor body 2. A valve cylinder 5 standing upright atop the carburetor body 1 houses a piston-type throttle valve 6, which is slidable therein, and opens and closes the inlet path 1*a*. The throttle valve 6 is opened and closed by a throttle grip G (see FIG. 1) via a throttle wire 7. The throttle grip G is attached to a steering handle H of the motorcycle M.

The float chamber 3 communicates with a fuel tank T of the motorcycle M via a well-known float valve (not shown) that is opened or closed by a float 21. Fuel is supplied to the float chamber 3 to a specified level in response to the opening and closing of the float valve. Further, the carburetor body 1 includes a fuel nozzle 8 which has its lower end immersed in fuel in the float chamber 3 and its upper end projecting to the inlet path 1*a* The fuel nozzle 8 injects fuel into the inlet path 1*a* from the fuel chamber 3.

A pair of ventilating units of the invention are provided in the carburetor body 1 in order to allow smooth transportation of fuel to and from the float chamber 3. They will be described hereinafter.

In the carburetor body 1, a pair of expansion chambers 11 are arranged at the upper part of the float chamber 3 in such a manner that they sandwich the inlet path 1*a*, and a pair of main air paths 12 are formed in order to enable the expansion chambers 11 to communicate with a space above the top surface of fuel in the float chamber 3. Further, the carburetor body 1 connects to first branches 13 for opening the bottom of the expansion chambers 11 to the atmosphere, and second branches 14 for opening the ceiling of the expansion chambers 11 to the atmosphere. The expansion chambers 11 are cylinders having substantially vertical axes, and communicate with the main air paths 12, and the first and second branches 13 and 14, all of which have different cross-sectional areas.

Each main air path 12 directly opens on the ceiling of the float chamber 3 via its lower end 12*a*, and has its upper end 12*b* projecting to a specified level from the bottom of each expansion chamber 11.

Each of the first branches 13 includes a lower tubular joint 15 which is cast to be coupled around the carburetor body 1 and opens on the bottom of each expansion chamber 11; and a first ventilating tube 16 connecting to the lower tubular joint 15 and extending to the lower part of the carburetor C. An outer end of the first ventilating tube 16 opens to the atmosphere, serving as a lower end 13*a* of the first branch 13. An inner end of the lower tubular joint 15 communicating with the expansion chamber 11 functions as an upper end 13*b* of the first branch 13.

Each second branch 14 includes an upper tubular joint 17 screwed to the carburetor body I so as to open on the ceiling of each expansion chamber 11 and a second ventilating tube 18 extending upwardly to an upper part of the carburetor C. Both of the second ventilating tubes 18 communicate with a third ventilating tube 20 via a T-shaped tubular joint 19. An outer end of the third ventilating tube 20 opens to the atmosphere, and serves as a lower end 14*a* of each second branch 14. Further, each inner end of the upper tubular joint 17 that opens on the ceiling of the expansion chamber 11 serves as an upper end 14*b* of the second branch 14.

Each upper end 12*b* of each main pair path 12 and each inner end 14*b* of each upper tubular joint 17 are arranged with their extension axes L1 and L2 mutually displaced.

The following describes the operation of this embodiment.

When the motorcycle M operates on a substantially flat and straight road with the operation of the internal combustion engine E, the top surface of fuel in the float chamber 3 remains relatively stable. Therefore, the float chamber 3 communicates with the atmosphere via the pair of main air paths 12, expansion chambers 11, and first and second branches 13 and 14, and is maintained at atmospheric pressure.

If the motorcycle M rolls and the surface of fuel in the float chamber 3 is extensively inclined to the left or right with respect to the carburetor C, one of the main air paths 12 is filled with fuel f while the other main air path 12 is not in contact with and is free from fuel f. In such a case, the float chamber 3 can be maintained at atmospheric pressure by the other main air path 12 that is free from fuel f, and the first and second branches 13 and 14 connecting therewith.

In a case where the motorcycle M repeatedly bumps up and down on a very rough road, the surface of fuel f in the float chamber 3 of the carburetor C becomes choppy, so that a relatively large amount of fuel f tends to gush into both of the main air paths 12. In such a case, fuel f is attenuated in the expansion chambers 11 having a large sectional area, and there is a sufficient room around fuel therein. Therefore, no fuel f intrudes into the first and second branches 13 and 14 at the same time.

Since the inner ends 13*b* of the first branches 13 and the inner ends 14*b* of the second branches 14 are extensively and vertically apart from one another, it is possible to prevent the simultaneous entrance of fuel f into the first and second branches 13 and 14.

The extension axes L1 of the upper ends 12*b* of the main air paths 12, which open on the bottom of the expansion chambers 11, and the extension axes L2 of the second branches 14, which open on the ceiling of the expansion chambers 11, are displaced from one another. Therefore, if fuel f enters into the expansion chambers 11 via the main air paths 12 and advances vigorously and straight, it cannot enter into the second branches 14, or an amount of fuel entering into the second branches can be reduced. In this embodiment, the third ventilating tube 20 commonly serves for the second left and right branches 14 in order to enable them to communicate with the atmosphere. This simplifies the structure of the ventilating unit and improves the ventilation of the second branches 14.

In addition, since no fuel f simultaneously intrudes into the first and second branches 13 and 14 from the expansion chambers 11, atmospheric pressure can continuously act on the expansion chambers 11 via either the first or second branches 13 or 14.

Fuel f attenuated in the expansion chambers 3 flows down through the main air paths 12 and the first branches 13. Especially, the main air paths 12 are so short that fuel f quickly returns to the float chamber 3, which enables the expansion chambers 11 to quickly become empty. Atmospheric pressure in the expansion chambers 11 can immediately act on the float chamber 3, which maintains the float chamber 3 at atmospheric pressure. Therefore, fuel f can smoothly enter into or out of the float chamber 3, thereby stabilizing the fuel injection of the fuel nozzle 8. Therefore, even when the throttle valve 6 is quickly opened, the internal combustion engine can be smoothly accelerated, which improves ridability.

When fuel f in the expansion chambers 11 flows downwardly via the main air paths 12 and the first branches 13, respectively, the upper ends 12*b* of the main air paths 12 are above the inner ends 14*b* of the lower tubular joints 15, so that no fuel f will return to the main air paths 12 before the expansion chambers 11 become empty. This is effective in extensively shortening the time period in which fuel f stays in the main air paths 12. Fuel f in the expansion chambers 11 and below the upper ends 12*b* of the main air paths 12 is completely discharged to the outside via the first branches 13 together with foreign objects or the like remaining on the bottom of the expansion chambers 11. It is possible to prevent such objects from entering into the float chamber 3.

The present invention is not limited to the foregoing embodiment, and can be changed or modified in a variety of ways without departing from the spirit thereof. For instance, the ventilating unit 10 may have three or more branches. Further, the lower ends 12*a* of the main air paths 12 may be arranged on the center of the ceiling of the float chamber 3, so that only one ventilating unit 10 may be provided for the carburetor.

According to the first feature of the invention, the ventilating unit for the carburetor comprises: the main air paths having lower ends opening to the space above the surface of the fuel in the float chamber of the carburetor and upper ends communicating with upper ends of a plurality of branches; and the branches open to the atmosphere via lower ends. The upper ends of the main air paths and the upper ends of the branches communicate with one another via the expansion chambers that are positioned above the float chamber and have larger cross-sectional areas than the cross-sectional areas of the main air paths of the branches. Therefore, even when a relatively large amount of fuel gushes into the main air paths from the float chamber, fuel passing through the main air paths can be attenuated in the expansion chambers, and there is a sufficient room around the fuel therein. As a result, it is possible to prevent fuel from simultaneously intruding into all of the branches, thereby maintaining the expansion chambers at atmospheric pressure. Fuel attenuated in the expansion chambers is quickly returned to the float chamber via the main air paths so that the float chamber can be maintained at atmospheric pressure, and the fuel injection nozzle can reliably inject fuel.

In accordance with the second feature of the invention, the upper ends of the branches open on the bottom and the ceiling of the expansion chambers, respectively. Further, the upper ends of the branches are spaced apart from one another, so that it is possible to reliably prevent simultaneous intrusion of fuel into the branches from the main air paths.

According to the third feature, the upper ends of the main air paths that open on the bottom of the expansion chambers and the lower ends of the branches that open on the ceilings of the expansion chambers are arranged with their extension axes displaced mutually relative to each other. Even when fuel gushes to the ceilings of the expansion chambers via the main air paths, it cannot intrude into the branches, thereby reliably maintaining the expansion chambers at atmospheric pressure.

In the fourth feature, the upper ends of the main air paths and the upper end of at least one of the branches open on the bottom of the expansion chambers, so that fuel can quickly flow down via the main air paths and the branches, respectively. Further, when the surface of fuel is below the upper ends of the main air paths, no fuel will be returned to the main air paths. This shortens the time period wherein fuel remains in the main air paths, and effectively maintains the float chamber at atmospheric pressure.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A ventilating unit for a carburetor comprising:

main air paths including lower ends opening to a space above a surface of fuel in a float chamber of a carburetor, upper ends communicating with one end of a plurality of branches wherein the branches open to the atmosphere via another end thereof;

wherein the upper ends of the main air paths and the upper ends of the branches communicate with one another via expansion chambers that are positioned above the float chamber and have larger cross-sectional areas than cross-sectional areas of the main air paths and the branches and wherein the branches open on a bottom and a ceiling of the expansion chamber.

2. The ventilating unit according to claim 1, wherein the main air paths opening on the bottom of the expansion chambers and at least one of the branches opening on the ceiling of the expansion chambers are arranged with extension axes thereof mutually displaced.

3. The ventilating unit according to claim 1, wherein the upper ends of the main air paths and the upper end of at least one of the branches open on the bottom of the expansion chambers, and the upper ends of the main air paths are positioned above the upper ends of the branches.

4. The ventilating unit according to claim 1, wherein the upper ends of the main air paths and the upper end of at least one of the branches open on the bottom of the expansion chambers, and the upper ends of the main air paths are positioned above the upper ends of the branches.

5. The ventilating unit according to claim 2, wherein the upper ends of the main air paths and the upper end of at least one of the branches open on the bottom of the expansion chambers, and the upper ends of the main air paths are positioned above the upper ends of the branches.

6. A ventilating unit for a carburetor comprising:

a float chamber for containing a predetermined quantity of fuel, said float chamber including an upper end and a bottom;

main air paths including lower ends and upper ends, said lower ends being in communication with a space disposed above a surface of the fuel in the float chamber of the carburetor;

first branches having lower ends and upper ends, said lower ends of said branches being open to the atmosphere;

at least one expansion chamber having a ceiling and a bottom, said bottom of said at least one expansion chamber being in communication with said upper ends of said main air paths and said bottom of said at least one expansion chamber being in communication with said upper ends of said first branches, said at least one expansion chamber being positioned above the float chamber and includes a larger cross-sectional area relative to a cross-sectional area of the main air paths and the branches; and second branches having lower ends and upper ends, said lower ends of said second branches being in communication with said ceiling of said at least one expansion chamber.

7. The ventilating unit according to claim 6, wherein the main air paths opening on the bottom of the expansion chambers and the second branches opening on the ceiling of the expansion chambers are arranged with extension axes thereof mutually displaced.

8. The ventilating unit according to claim 6, wherein the upper ends of the main air paths and the upper end of at least one of the first branches open on the bottom of the expansion chambers, and the upper ends of the main air paths are positioned above the upper ends of the first branches.

9. The ventilating unit according to claim 7, wherein the upper ends of the main air paths and the upper end of at least one of the first branches open on the bottom of the expansion chambers, and the upper ends of the main air paths are positioned above the upper ends of the first branches.

* * * * *